US011145502B2

(12) United States Patent
Baldwin et al.

(10) Patent No.: US 11,145,502 B2
(45) Date of Patent: Oct. 12, 2021

(54) EMISSION CURRENT MEASUREMENT FOR SUPERIOR INSTRUMENT-TO-INSTRUMENT REPEATABILITY

(71) Applicant: Thermo Finnigan LLC, San Jose, CA (US)

(72) Inventors: Lawrence G. Baldwin, Hutto, TX (US); Johnathan Wayne Smith, Round Rock, TX (US); Edward B. McCauley, Austin, TX (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 16/721,517

(22) Filed: Dec. 19, 2019

(65) Prior Publication Data

US 2021/0193449 A1 Jun. 24, 2021

(51) Int. Cl.

| | |
|---|---|
| ***H01J 49/14*** | (2006.01) |
| ***H01J 49/02*** | (2006.01) |
| ***H01J 49/26*** | (2006.01) |

(52) U.S. Cl.

CPC ..... *H01J 49/147* (2013.01); *H01J 49/022* (2013.01); *H01J 49/26* (2013.01)

(58) Field of Classification Search

CPC ..... H01J 49/147; H01J 49/022; H01J 49/26
See application file for complete search history.

(56) References Cited

U.S. PATENT DOCUMENTS

| | | | |
|---|---|---|---|
| 4,540,884 | A | 9/1985 | Stafford et al. |
| 4,736,101 | A | 4/1988 | Syka et al. |
| 5,750,993 | A | 5/1998 | Bier |
| 5,756,996 | A | 5/1998 | Bier et al. |
| 6,294,780 | B1 | 9/2001 | Wells et al. |
| 7,323,682 | B2 | 1/2008 | McCauley et al. |
| 7,507,954 | B2 | 3/2009 | McCauley et al. |
| 7,759,655 | B2 | 7/2010 | McCauley |
| 7,858,933 | B2 | 12/2010 | Kawana et al. |
| 7,902,529 | B2 | 3/2011 | Quarmby et al. |

(Continued)

FOREIGN PATENT DOCUMENTS

| | | | |
|---|---|---|---|
| GB | 1131495 | A | 10/1968 |
| WO | 2016/092696 | A1 | 6/2016 |

OTHER PUBLICATIONS

D'Autry et al., "Characterization and Improvement of Signal DriftAssociated with Electron Ionization Quadrupole Mass Spectrometry", Anal. Chem. 2010, 82, pp. 6480-6486.

(Continued)

*Primary Examiner* — Nicole M Ippolito
*Assistant Examiner* — Hanway Chang
(74) *Attorney, Agent, or Firm* — David A. Schell

(57) ABSTRACT

An ion source assembly is described that includes an electron source configured to inject electrons into an ion volume to ionize an atom or molecule in the ion volume, wherein the electron source includes a filament. A lens electrode is positioned adjacent the electron source and includes an opening configured to pass electrons therethrough from the electron source into the ion volume. A supply voltage source is coupled to the filament and configured to supply a first voltage to the filament, wherein the first voltage is operable to ionize the molecules in the ion volume. Further, a bias voltage source is coupled to the supply voltage source and configured to supply a bias voltage to the lens electrode. Electrons striking the lens electrode are thereafter returned to the filament.

20 Claims, 10 Drawing Sheets

(56) References Cited

U.S. PATENT DOCUMENTS

| | | | |
|---|---|---|---|
| 2004/0238755 | A1 | 12/2004 | Lee et al. |
| 2006/0016978 | A1 | 1/2006 | McCauley et al. |
| 2007/0132357 | A1 | 6/2007 | Wells et al. |
| 2009/0032702 | A1 | 2/2009 | Quarmby et al. |
| 2009/0194680 | A1 | 8/2009 | Quarmby et al. |
| 2014/0252222 | A1 | 9/2014 | Rafferty et al. |

OTHER PUBLICATIONS

Evans-Nguyen et al., "Development of a low power, high mass range mass spectrometer for Mars surface analysis", International Journal of Mass Spectrometry 278 (2008), pp. 170-177.

March, R. E. (2012), "Quadrupole Ion Trap Mass Spectrometer", Update based on the original article by Raymond March, Encyclopedia of Analytical Chemistry, ©2000, John Wiley & Sons, Ltd., In Encyclopedia of Analytical Chemistry (eds R. A. Meyers and R. A. Meyers). doi:10.1002/9780470027318.a6015.pub2.

Appelhans et al., "Electron flood charge compensation device for ion trap secondary ion mass spectrometry", International Journal of Mass Spectrometry 221 (2002), pp. 21-38.

EMISSION CURRENT MEASUREMENT FOR SUPERIOR INSTRUMENT-TO-INSTRUMENT REPEATABILITY

TECHNICAL FIELD

The present disclosure is directed to the field of mass spectrometry. More particularly, the present disclosure relates to a mass spectrometer system and method that provides for improved electron ionization and measuring the effective emission current of an electron beam used for electron ionization.

BACKGROUND OF THE INVENTION

Referring to FIG. 1, an ion trap mass spectrometer includes a ring electrode 11 and end caps 12 spaced from one another. An RF generator 14 applies an RF voltage to the ring electrode 11 to supply an RF voltage between the end caps 12 and the ring electrode 11 to provide a substantially quadrupole field for trapping ions in the ion volume 15 (or otherwise referred to herein as an "ion trap") between the end caps 12 and ring electrode 11. A supplementary RF generator 17 is coupled to the end caps 12 by the transformer 16 and supplies an axial RF voltage between the end caps 12. A heated filament 18 is held at a negative potential with respect to the ion trap DC or offset voltage. Electrons emitted by the filament 18, such as by thermionic emission, are accelerated into the ion volume 15 and through an opening 13 in the end cap 12. The electrons are gated into the ion volume 15 by a gate electrode 19 so that molecules or atoms are ionized in the interior of the ion volume 15 only during ionization of the sample molecules introduced into the ion volume 15. As is known, the amplitude of the fundamental RF voltage is scanned to bring successive ions formed in the ion volume 15 into resonance with the supplementary RF field, the ion trajectories increase until they exit from the perforated end cap 12 and are detected by continuous dynode electron multiplier. The electron multiplier converts the ion current into an electrical signal which is plotted as a function of time to provide a mass spectrum. Operation of ion trap mass spectrometers is described in U.S. Pat. No. 4,540,884, entitled "Method of Mass Analyzing a Sample by Use of a Quadrupole Ion Trap," issued Sep. 10, 1985, and U.S. Pat. No. 4,736,101, entitled "Method of Operating Ion Trap Detector in MS/MS Mode," issued Apr. 5, 1988, wherein the disclosures of both patents are incorporated herein by reference.

It has been found that the electron multiplier can also produce electrical signals in a non-coherent manner during the period that the electron multiplier is energized. These signals are often referred to as "noise." Experiments have shown that the noise signals produced come from two sources: 1) ions produced external to the trapping volume 15 by filament 18 produced electrons, and 2) ions resulting from excited neutral particles striking the surface of the ion volume 15. Since the filament 18 is typically operated at a high negative voltage potential, such as −70 electron volts (eV), electrons emitted by the filament 18 ionize gas molecules external to the ion volume 15. These electrons may not enter the ion volume 15 due to repulsion forces by the gate electrode 19, but the electrons can instead drift through the ion trap vacuum chamber 21. When these ions reach the area of the electron multiplier, they are accelerated to the multiplier surface by the high negative voltage potential of the multiplier dynode and therefore they can generate noise signals. When large numbers of helium molecules are present, the helium molecules are bombarded by the energetic electrons, thereby producing positive helium ions in addition to excited neutral molecules. These energetic particles strike surfaces with sufficient energy to sputter off adsorbed molecules/atoms, and ions.

It was realized that if the electron energy was reduced to below 14 eV, neither helium nor excited neutral ions may be formed external to the ion volume 15 because the electron energy may be too low to create such ion species. However, when these low energy electrons entered into the ion volume 15, they can pick up enough energy, during one-half of the RF cycle, and hence may be able to have sufficient energy (e.g., 30-130 eV) to efficiently ionize molecules within the ion volume 15. To prevent this phenomenon, one can build an emission regulator to provide a constant electron emission by the filament at a filament bias voltage of about −12 V. The role of the grounded lens 22 is to isolate the filament region from the charging potential of the gate lens 19 to facilitate filament emission regulation. This system allows ion formation within the ion volume 15 having minimal noise because the electron energy external to the ion volume 15 was not high enough to ionize helium atoms or create excited helium neutrals.

The foregoing solution applies to internal ionization, including systems where the RF ion trap voltage cooperates with the filament voltage to provide sufficient ionizing energy during one-half of the RF cycle. When an ion trap mass spectrometer is used to analyze the effluent from a gas chromatograph, it is advantageous that the ionization take place external to the ion volume 15. Ions which are formed are then transported into the ion volume 15 with a multi-element gating system. One of the elements can be used as an ion gate, switching between two potentials, one potential which focuses ions into the trap and one which stops ion transmission. Such a gating arrangement is disclosed in U.S. Pat. No. 5,750,993, entitled "Method of Reducing Noise in an Ion Trap Mass Spectrometer Coupled to an Atmospheric Pressure Ionization Source," issued May 12, 1998, the disclosure of which is incorporated herein by reference.

Mass spectrometers employing electron ionization rely on emission current feedback or collector current feedback in order to close the loop on filament current. Typically, a rhenium or tungsten cathode filament is employed as the electron emitter and is heated to incandescence in order to affect thermionic emission from the surface of the wire. A separate bias supply is used to replenish electrons emitted into free space. FIGS. 2A-2B generally illustrate prior art methods for measuring and replenishing emitted electrons in accordance with emission current regulation and collector current regulation respectively. Referring to FIG. 2A, a filament 30 emits electrons past an opening in filament shroud 29, and through an opening in an electron lens 31 into an ion volume 32 through an opening 34 in the ion volume 32. Emitted electrons can be measured by measuring the potential drop across a feedback resistor 36 as part of a floating filament power supply 38. Alternatively, referring to FIG. 2B, emitted electrons can be measured by an electron collector 40 on the opposite side of the ion volume 32 through electron exit aperture 42.

While suitable for most purposes, the above measurement techniques are prone to measurement inaccuracies concerning the actual electron current delivered into the ion volume 32. For example, using a conventional filament wire 30 located in close proximity to an electron entrance aperture 34, will result in a portion of the emitted electrons impacting the side of the ion volume 32 and the electron lens 31 rather than making it into the ion volume 32. Conversely, a collector 40 used to measure electrons which traverse an ion volume 32 will not measure electrons impacting the near inner surface of the ion volume near the electron exit aperture 42.

While these measurement techniques can result in a steady-state emission current suitable for most purposes within the field of mass spectrometry, small differences in filament alignment, magnet position, magnetic field, or other variables of the electron ionizer can affect the ion signal strength ultimately formed. Embodiments of this disclosure provide improved systems and methods for emission current regulation of an electron beam used for continuous electron ionization and provides improvements for ions formed in pulsed electron ionization processes.

The systems and methods described herein may also be utilized for pulsed-ion sources used on continuous beam mass spectrometry instruments. Such an instrument is described in U.S. Pat. No. 7,323,682, entitled "Pulsed Ion Source for Quadrupole Mass Spectrometer and Method," issued on Jan. 29, 2008 (the "'682 Patent"), the contents of which are hereby incorporated by reference.

BRIEF SUMMARY OF THE INVENTION

In accordance with the concepts described herein, an ion source assembly is described that can include an electron source configured to inject electrons into an ion volume to ionize an atom or molecule in the ion volume, wherein the electron source can include a filament. The ion source assembly can further include a lens electrode positioned adjacent the electron source and having an opening, wherein the opening can be configured to pass electrons therethrough from the electron source into the ion volume. Still further, the ion source assembly can include a supply voltage source coupled to the filament, wherein the supply voltage source can be configured to supply a first voltage to the filament which is operable to ionize the molecules in the ion volume. In some aspects, the ion source can also include a bias voltage source coupled to the supply voltage source and configured to supply a bias voltage to the lens electrode, wherein the bias voltage can be configured to remain at a fixed voltage potential relative to the supply voltage source.

In another aspect, an ion source assembly can include a filament configured to emit electrons via thermionic emission and a lens electrode surrounding the filament. Further, an ion source assembly can include a first power supply coupled to the filament, wherein the first power supply can be configured to supply a first voltage output at a first voltage slew rate to the filament. The first voltage output can be operable to ionize molecules. Still further, an ion source assembly can include a second power supply coupled to the lens electrode, wherein the second power supply can be configured to supply a second voltage output at a second voltage slew rate to the lens electrode. In some aspects, the ion source assembly can optionally include a first capacitor coupling the first voltage output to the second voltage output, and a resistor coupled between the second voltage output and the lens electrode. The first capacitor and the resistor can be operable to align the first voltage slew rate with the second voltage slew rate.

The systems and methods disclosed can provide improved instrument-to-instrument repeatability in ion response, a decreased number of power supplies needed for pulsed-mode operation, and improved slew rate matching including a reduced or eliminated need for offset matching, thereby resulting in improved emission regulation in pulsed-emission mode.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
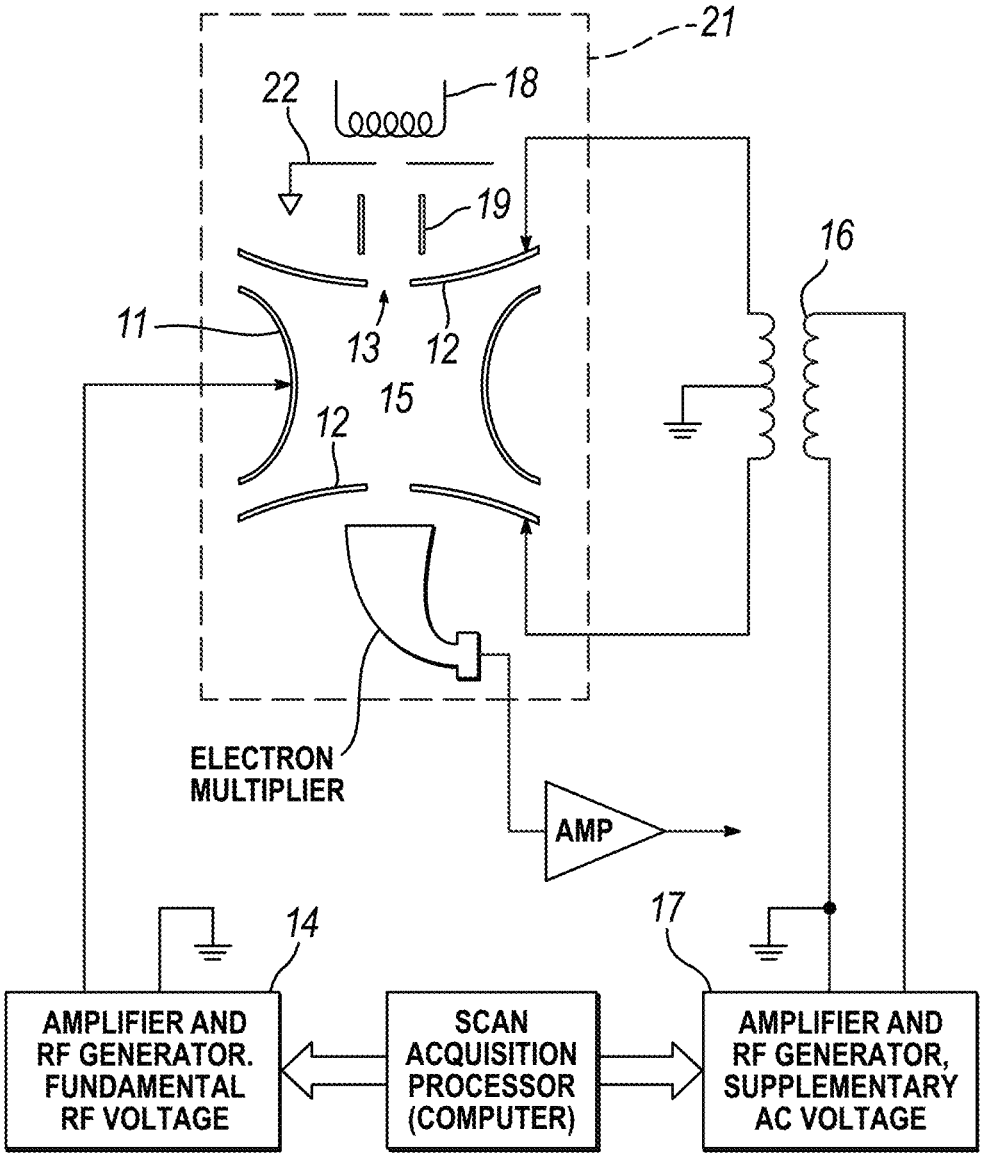
FIG. 1 PRIOR ART
FIG. 1 depicts a schematic diagram of a prior art ion trap mass spectrometer.
Figure 2B:
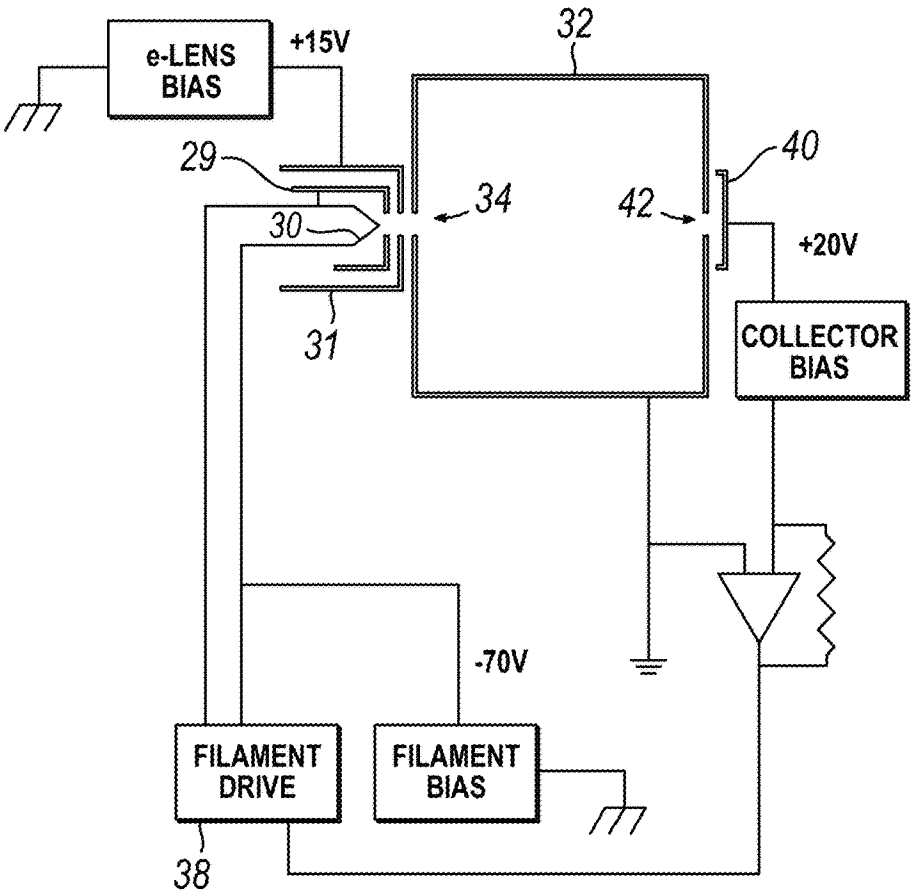
FIG. 2B PRIOR ART
FIGS. 2A and 2B depict schematic diagrams of prior art emission current regulation and collector current regulation circuits, respectfully.
Figure 2A:
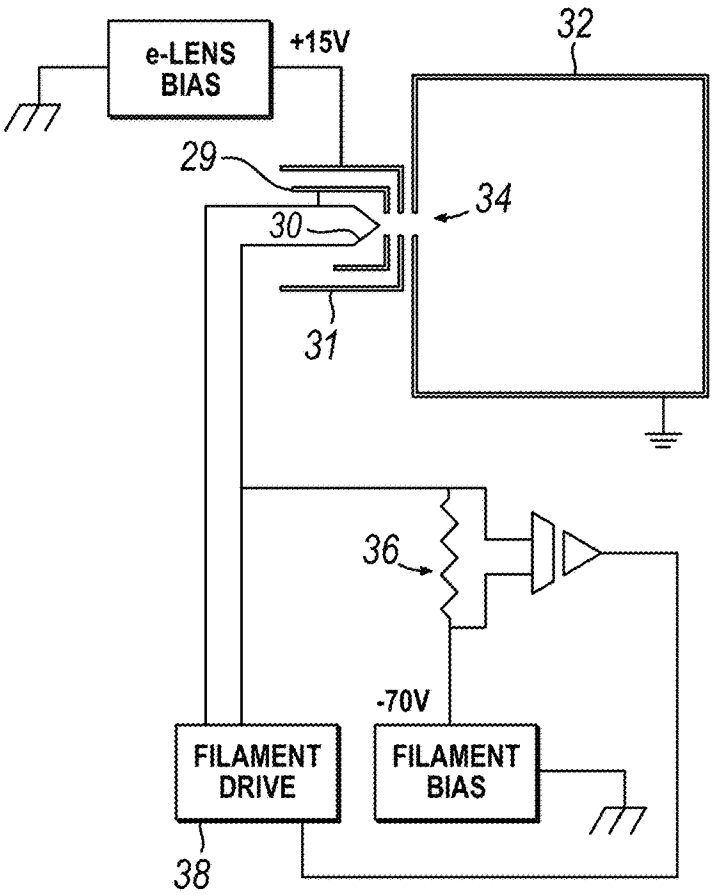
FIG. 2A PRIOR ART

Embodiments of systems and methods for improved emission current measurements are described herein and in the accompanying exhibits.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

It is to be noted within this specification that the term "floating" refers to a circuit, power supply, or other electrical feature which does not possess a ground which is common with earth ground. Conductors, such as filaments and electron lenses, are also described as having a floating potential if they are connected electrically to another floating conductor. For example, a filament power supply used to heat a filament to incandescence may supply a few amperes of current at only one or two volts across the filament. If the power supply does not have its ground in common with earth ground, the entire circuit can be said to "float" as its potential is not established. Establishing a potential (relative to earth ground) can be accomplished by providing a bias voltage source which has its ground in common with earth ground. Likewise, an electron lens is not floating if its power supply has its ground connected to earth ground but is floating if its ground is connected to another floated circuit such as a floated filament power supply.

U.S. Pat. No. 5,756,996, entitled "Ion Source Assembly for An Ion Trap Mass Spectrometer and Method," issued May 26, 1998 (the "'996 Patent"), the disclosure of which is incorporated herein by reference, generally describes a gating mechanism for ion traps wherein the ionizing electron beam energy is changed from a first value wherein ions are generated, and a second value wherein ions are not generated.

AGC (Automatic Gain Control) control methods for beam instruments are described in the '682 Patent, U.S. Pat. No. 7,507,954, entitled "Pulsed Ion Source for Quadrupole Mass Spectrometer Method," issued Mar. 24, 2009, and U.S. Pat. No. 7,759,655, entitled "Pulsed Ion Source for Quadrupole Mass Spectrometer and Method," issued Jul. 20, 2010, the disclosures of which are herein incorporated by reference. Unlike ion traps which use AGC to control ion formation at a batch level for a wide mass range, AGC for quadrupoles can control ion formation on a mass-to-mass basis while individual ions are being scanned by the multipole. This can be used to suppress non-target matrix ions for full scan experiments or prevent detector saturation for MRM experiments amongst other modes.

The '996 Patent describes an electron gating scheme wherein a filament bias potential is switched between two different negative values. An electron lens potential is also switched between two different positive values. The switching is synchronized to happen at the same time, such that a constant potential difference is maintained between the filament and the electron lens. This allows the ability to turn the ionization process on and off without disruption of the emission regulation process. It requires four independent potentials and switching means for both channels. As such, the method and hardware employed in the '996 Patent synchronizes the gate times of the filament and electron lens. This results in the ability to gate the ionization process without unduly affecting the control (i.e., the precision) of emission current. This is largely due to the fact that the injection times are relatively long (e.g., within the millisecond time domain). The '996 Patent further describes systems which eliminate neutral noise formation during scan out of ions from an ion trap.

Figure 4:
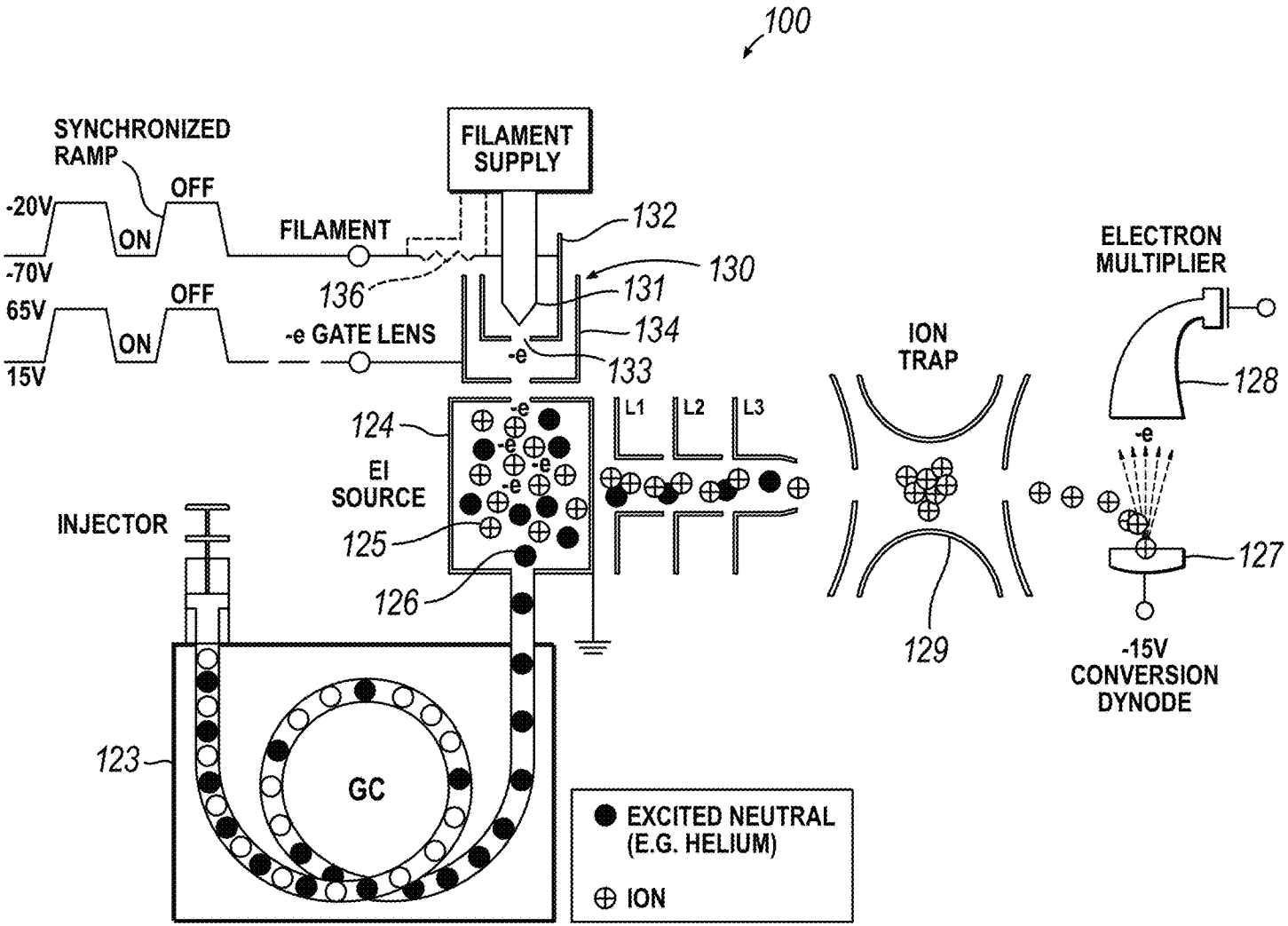
FIG. 4 PRIOR ART
FIG. 4 depicts a schematic diagram of a prior art ion trap mass spectrometer system, including an electron gating scheme having a floated filament power supply, a switched, ground referenced filament bias potential and a switched, ground referenced electron gate lens.

Referring to the ion trap mass spectrometer 100 of FIG. 4, a gas chromatograph 123 provides sample gas to an ion volume 124. An electron source 130 provides energetic electrons to the ion source to ionize the atoms and molecules in said device and form positive ions 125 and unwanted excited neutrals 126. The ions are guided or gated into the ion trap 129 by the multi-element lens L1, L2, and L3. The ion volume 124 and its operation is as described above. The ejected ions from the trap are converted to electrons by conversion dynode 127 and multiplied by the electron multiplier 128 which provides the output electrical signal representative of the ion abundance.

In accordance with the present invention, the energy of the electrons leaving the filament 131 and entering the ion volume 124 is controlled so that it is sufficient to ionize sample molecules and helium 126 within the source volume 124 only during the ionization time. The electron source includes a filament 131 which is heated to emit electrons.

Figure 5A:
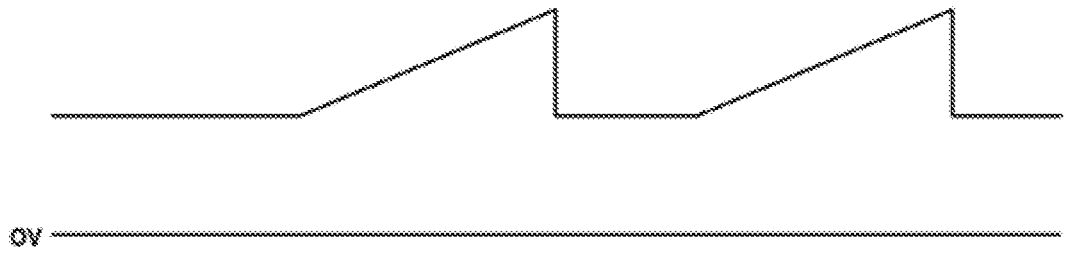
FIGS. 5A-E depict timing diagrams illustrating the operation of the ion source and ion trap of FIG. 4.
Figure 5B:
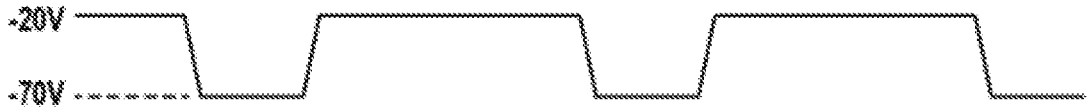
Figure 5C:
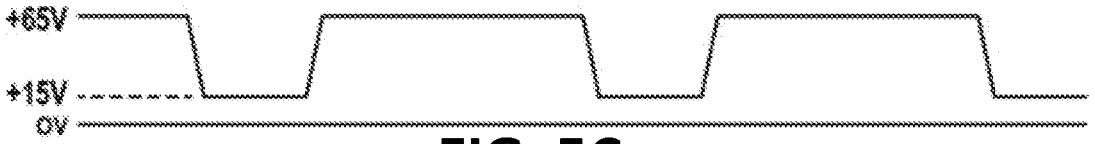
Figure 5D:
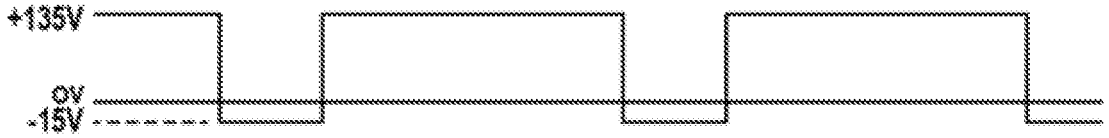
Figure 5E:
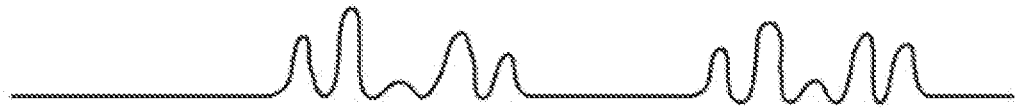

The filament may comprise a refractory material such as tungsten, rhenium or another suitable alloy for thermionic emission. The heating current supplied to the filament 131 is from a floated power supply and is controlled to provide substantially constant electron emission. A filament shroud 132 is electrically common with filament 131 and assures that emission of electrons is at the opening 133. The energy of electrons entering the ion source volume 124 is controlled by the voltage between the filament 131 and the ion source volume 124. Seventy eV has been found to be an electron energy satisfactory for ionizing atoms and molecules, though higher or lower electron energies may be used. In accordance with the present invention, the filament voltage and/or excitation voltage is reduced to a voltage below the ionizing voltage for helium during nonionizing periods. FIG. 5A shows operation of the ion trap 129. The fundamental RF voltage is low as the ion trap is filled with sample ions. The voltage is then increased to provide a mass spectrum, FIG. 5E. Ions are formed and gated into the ion trap when the fundamental RF voltage is low. FIG. 5B shows the voltage applied to the filament 131 from a voltage source (not shown) during ionization and during analysis. The voltage is at minus 70 volts during ionization thereby providing electrons having sufficient energy to ionize the sample molecules. During this period, the electron gate lens 134 is at a low positive voltage, for example 15 volts, FIG. 5C. During the analyzing cycle, the voltage applied to the filament 131 by the source voltage is lowered to minus 20 volts. Electrons entering the ion source volume do not have sufficient energy to ionize sample or helium molecules and few, if any, excited ions are formed. The voltage on the gate lens 134 is increased to 65 volts. The voltage difference between the lens and filament is substantially constant. It is important that the potential difference between the filament and the gate lens remain substantially constant during the analysis cycle as otherwise there would be a perturbation of the emission of electrons from the filament and defeat the regulation of emission current. Thus, the filament sees substantially constant surroundings and the emission current can be regulated. During the ionization period, one of the lens elements L1, L2 or L3 is switched from a high positive potential, +135 v, to a low negative potential, −15 v, FIG. 5D, so as to prevent negative ions from entering the ion trap.

Upon being emitted, a certain number of electrons will strike the filament shroud 132. These electrons will not be counted as emission current since they return to the floated filament supply and are of no consequence. On the contrary, electrons striking the electron lens 134 represent a path to earth ground and will be counted as emission current. These counted electrons do not take part in actual ionization within ion volume 124 and so may be referred to as representing false emission current. The number of electrons which will strike the electron lens 134 is variable and depends on the precise alignment of the filament 131, the magnets (not shown) driving the movement of the electrons into the ion volume 124, and/or any small changes in positions of other elements of the electron source 130. In this arrangement, as the loop is closed on emission current, emitted electrons which strike the electron lens 134 are counted as false emission current, affecting the ability to accurately and efficiently control the electron emission. Therefore, errors or switching noise can be introduced in the election emission control system which vary instrument to instrument, or if the device is disassembled and reassembled, resulting in varying emission measurement responses.

In some embodiments, filament supply, filament shroud 132, and filament 131 derive their potential through an emission current sense resistor 136. A typical emission current value may be 50 microamperes using a current sense resistor of 1,000 ohms. In this arrangement, the electron source 130 comprises an electron lens 134 which does not derive its potential through the emission current sense resistor 136. Instead, the potential of electron lens 134 is controlled by an independent gate lens supply (not shown) which is referenced to earth ground. As such, electrons which strike the electron lens 134 subsequently have a path to earth ground and do not return to the filament supply.

Figure 6:
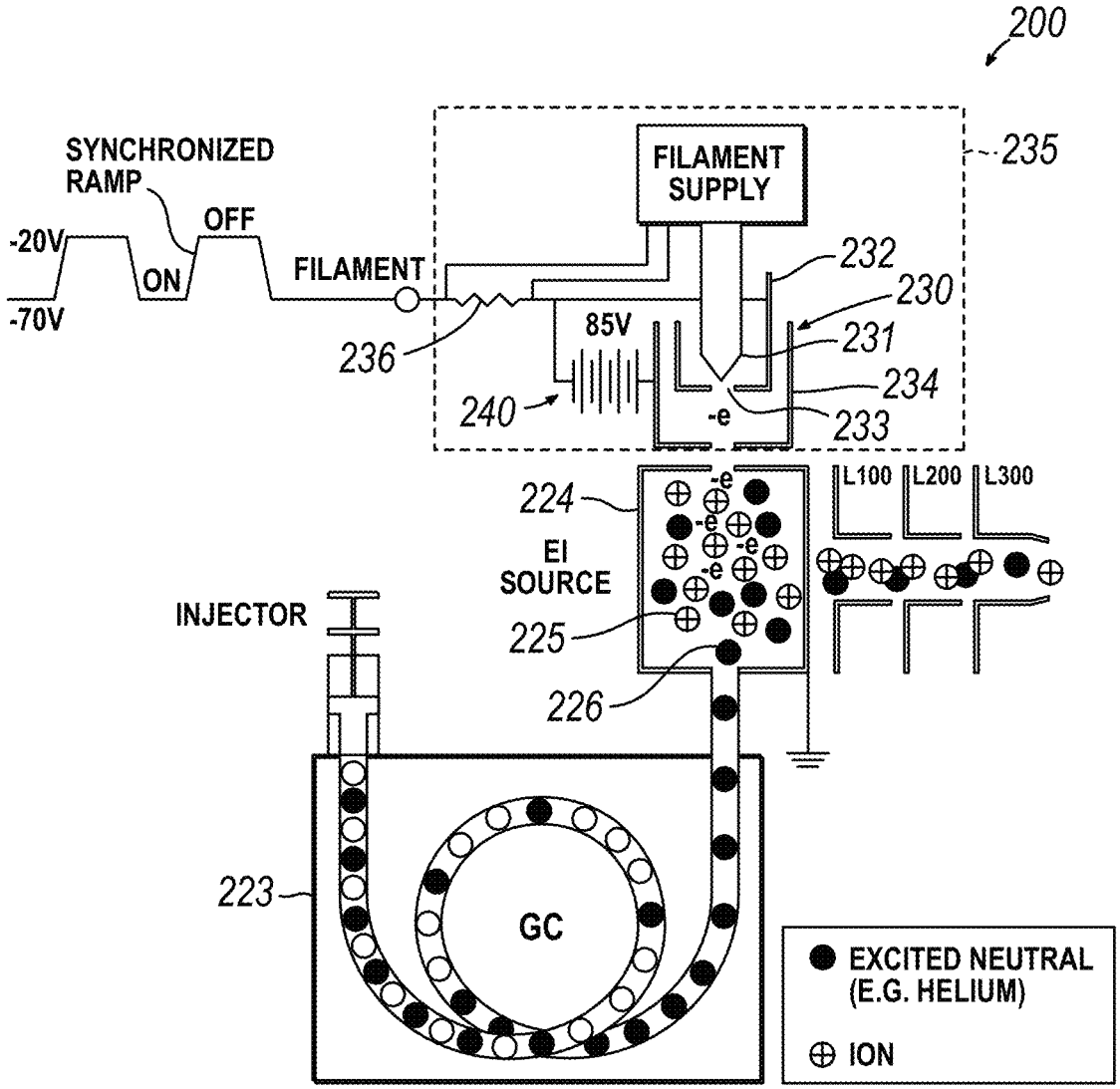
FIG. 6 depicts a schematic diagram of a first ion trap mass spectrometer system, including an electron gating scheme having floated filament power supply, a switched, ground referenced filament bias supply and a non-switched, floated electron lens bias supply.

FIG. 6 shows an ion trap mass spectrometer 200 in accordance with an embodiment which includes substantially the same features and functionality as ion trap mass spectrometer 100 except as otherwise described below. Accordingly, spectrometer 200 includes a gas chromatograph 223 which provides sample gas to an ion volume 224, and an electron source 230 which provides energetic electrons to the ion source to ionize the atoms and molecules in said device and form positive ions 225 and undesired excited neutrals 226. Further, the ions are guided or gated into an ion trap or quadrupole by the multi-element lens L100, L200, and L300.

Additionally, the energy of the electrons leaving the electron source 230 and entering the ion volume 224 is controlled so that it is sufficient to ionize sample molecules and helium 226 within the source volume 224 only during the ionization time. The electron source includes a filament 231 which is heated to emit electrons and is controlled to provide substantially constant electron emission. Filament shroud 232 assures that emission of electrons is at the opening 233. The energy of electrons entering the ion source volume 224 is controlled by the voltage between the filament 231 and the ion source volume 224. Although the ion volume is shown grounded, the ion volume may also be held at a slight e.g. 10 volts positive or negative potential relative to earth ground in order to control the energy of ions leaving the source. These techniques are well known in the art.

Spectrometer 200 also incorporates an emission current sensing resistor 236 for measuring the current emitted from the filament 231 using the technique described above with reference to FIG. 4. In the embodiment of FIG. 6, however, the independently switched electron lens gate supply is omitted, being replaced with a non-switched bias supply 240 which floats along with other elements as a grouping 235. Current sensing resistor 236, filament 231, filament shroud 232, and electron gate lens 234 form an electrically floated grouping 235. Upon being emitted, a certain number of electrons will strike the floated electrode 232 or the floated electron lens 234, which are separate electrodes from the grounded ion volume 224. In this embodiment, as the loop is closed on emission current, emitted electrons which strike the electrically floated grouping 235, such as floated electrode 232 or floated electron gate lens 234, are returned to the filament supply and are not counted as false emission current. Therefore, errors can be minimized in the electron emission control system, resulting in more consistent emission measurement responses and improved instrument to instrument repeatability.

The non-switched DC bias voltage supply 240, such as an 85 V DC bias, can be applied between the filament 231 and the electron lens 234. The DC bias voltage supply 240 eliminates the need for separate a switched electron lens supply as is deployed by the prior art. By including the DC bias voltage supply 240, the electron lens 234 can be floated along with the filament 231. As such, the voltage switching of the filament 231 potential propagates to the electron lens 234 through the bias supply 240 without the need of separate synchronized power supplies. For example, when the filament potential is at −20 V, the electron lens is at +65 V. Conversely, when the filament is at −70V, the electron lens is at +15V, the difference being set by the bias voltage 240. This further eliminates the need for two power supplies having highly matched voltage characteristics on each rail, and ensures better matched slew rates (i.e., how accurately the potentials follow each other on the electrodes) between the filament 231 and electron lens 234 potentials, resulting in decreased noise signal in the emission sense circuitry. Furthermore, it results in more accurate sensing of the true emission current delivered to the ion volume. This emission control scheme can be deployed in a continuous or pulsed mode of operation. It is preferable that the diameter of the entrance aperture of ion volume 224 be equal in size or larger than the aperture of electron lens 234. This ensures a minimum of false electron emission sensing due to electron collisions with the ion volume 224 which also have an electrical path to earth ground.

Figure 7:
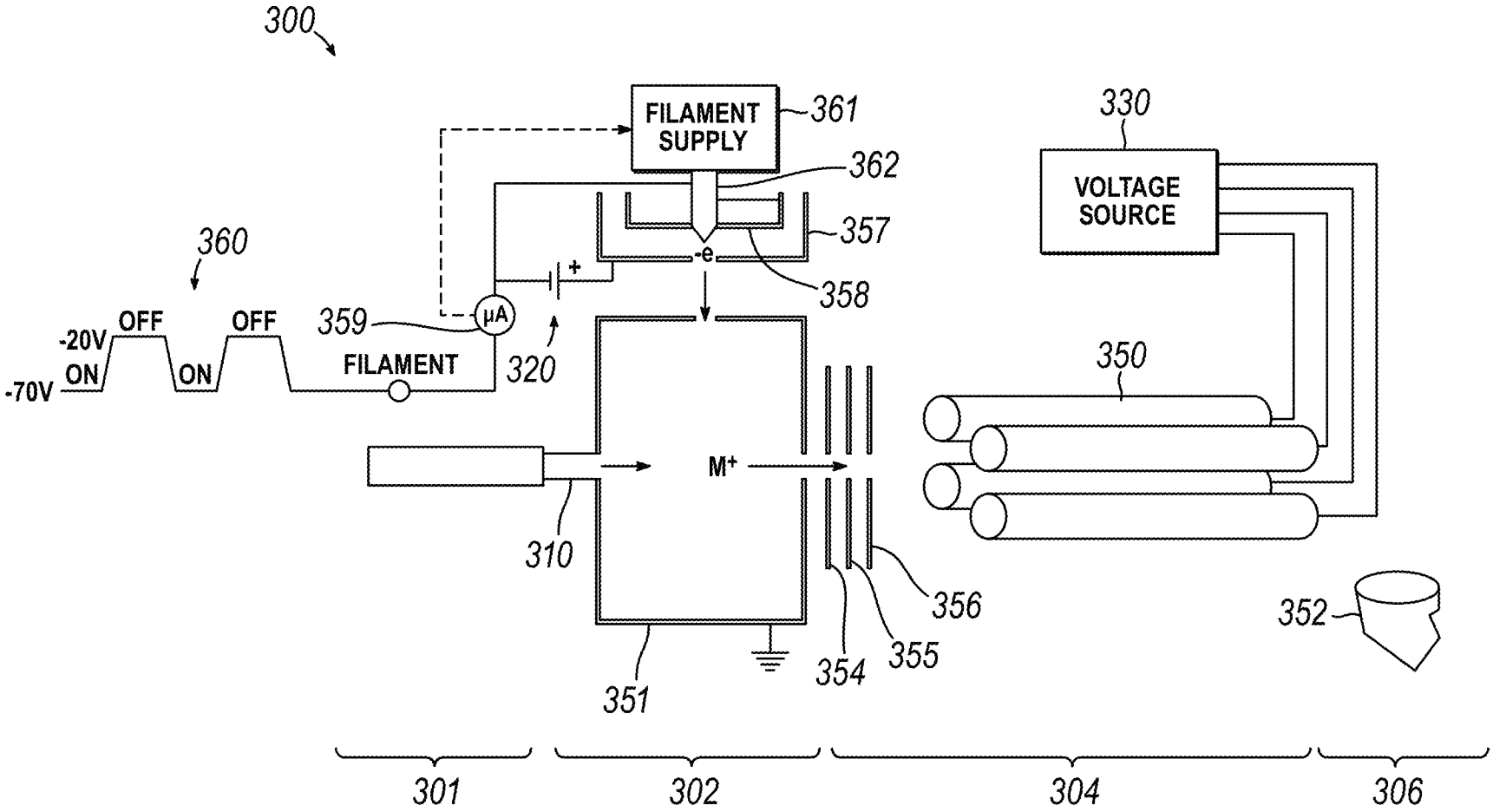
FIG. 7 depicts a schematic diagram of a quadrupole mass spectrometer system, including an electron gating scheme having a floated filament power supply, a switched, ground referenced filament bias potential and a non-switched, floated electron lens supply.

Referring to FIG. 7, the gating schemes described herein are also applicable to pulsed ion sources used on continuous beam instruments. Such a mass spectrometer 300 is described in the '682 Patent. Mass spectrometer 300 includes a source 301, such as a gas chromatograph, of sample particles, such as atoms or molecules. The mass spectrometer includes an ion source 302 to ionize the sample molecules, a mass filter 304, such as a quadrupole mass filter, to separate the ions from the ion source 302 based on their mass-to-charge ratio, and a detector 306 to detect the ions separated by the mass filter 304.

The sample molecules from the gas chromatograph 301 can be carried through a passage or orifice 310 into an ion volume 351 of the ion source 302 by a carrier gas, such as helium. It should be noted that the ion volume 351 could be any region where atoms or molecules are ionized. For example, the ion volume 351 could be a typical external ion source or it could be an ion trap or a quadrupole, octupole, or another multipole.

An electron source such as a filament 362 powered by a filament supply 361 is biased by a voltage source 360. The filament 362 emits electrons which pass through a gate 357 as they are accelerated toward the grounded ion volume 351. It should be noted that any electron source could be used such as an electron field emitter or cold cathode, or electron generator array. The filament 362 can also be coupled to a reflector 358 so that the reflector 358 and the filament 362 are at the same potential in order to provide a uniform electric field between the filament and gate.

Emitted electrons gain kinetic energy as they travel toward the ion volume 351 and subsequently ionize a portion of sample molecules existing within the confines of the ion volume 351. Voltage source 360 applies a voltage switchable between first and second voltages to the filament 362 and reflector while a DC bias supply 320 applies a bias voltage to the gate 357 in order to keep the voltage potential between the filament 362 and gate 357 constant. By keeping the voltage potential between the filament 362 and gate 357 constant, emitted electrons can be moved between energies which alternately permit ionization and limit ionization without affecting the potential differential and generating noise signals due to unmatched slew rates or offset potentials of the power supplies.

Ions generated in the ion volume 351 are extracted and focused in a continuous manner by a set of lens elements 354, 355, and 356 and are drawn into the rods 350 of the quadrupole mass filter 304. A voltage source 330 applies radio frequency (RF) and DC potentials to the rods of the mass filter to allow for selective mass transmission to the detector 306, which can include an electron multiplier 352, an amplifier, and a means of converting this analog signal to a digital signal.

Further, filament 362, reflector 358, and lens 357 may each be electrically floated such that the current emitted from the filament 362 can be accurately measured by a sensor 359, and the sensed current can be fed back to the filament supply 361. More specifically, in this embodiment, as the loop is closed on emission current, emitted electrons which strike the floated reflector 358 or floated gate 357, are returned to the filament supply 361 and are not counted as false emission current. Therefore, errors can be minimized in the election emission control system, resulting in more consistent emission measurement responses and improved instrument to instrument repeatability.

While the embodiments shown by FIGS. 6-7 and described herein illustrate and describe an ion source where the incoming electron beam and the resultant ion beam are orthogonal, it should be understood that the incoming electron beam and the resultant ion beam may instead be non-orthogonal. For example, the incoming electron beam and the resultant ion beam may also, in some embodiments, be co-axial or obliquely oriented.

Figure 3A:
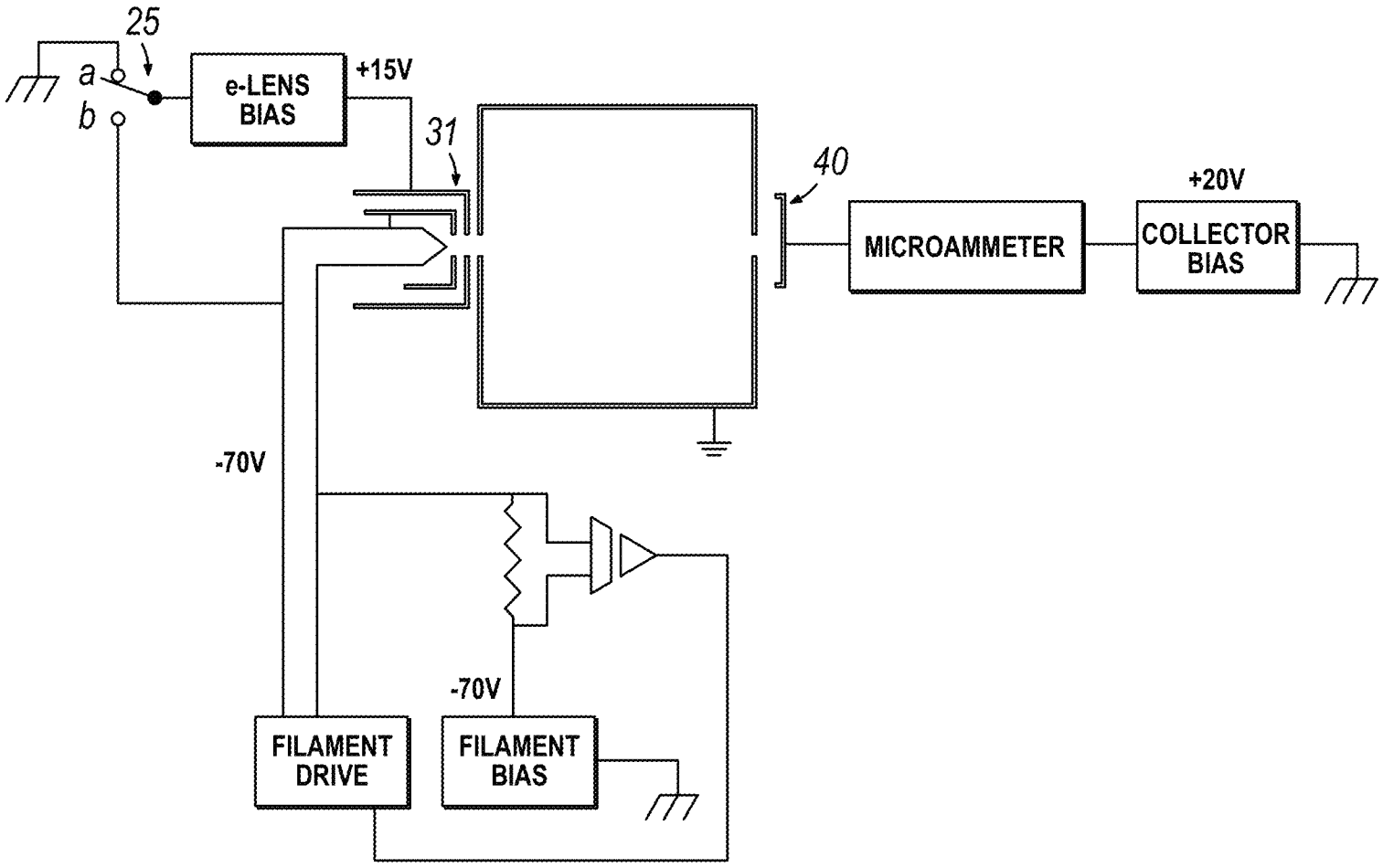
FIG. 3A depicts a schematic diagram of an experimental configuration for determining emission current regulation characteristics.
Figure 3B:
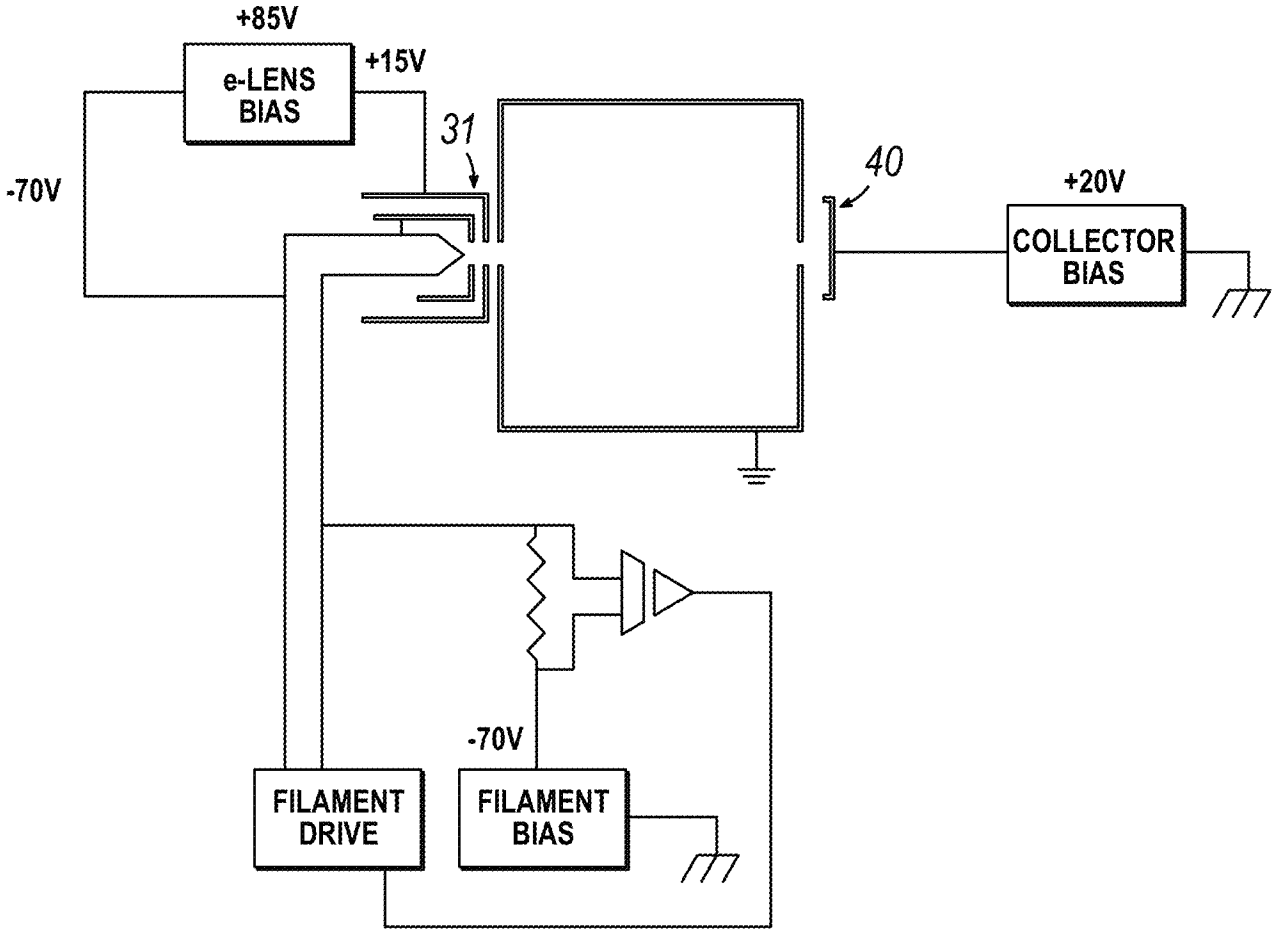
FIG. 3B depicts an embodiment utilizing a filament referenced electron lens bias supply.
Figure 8:
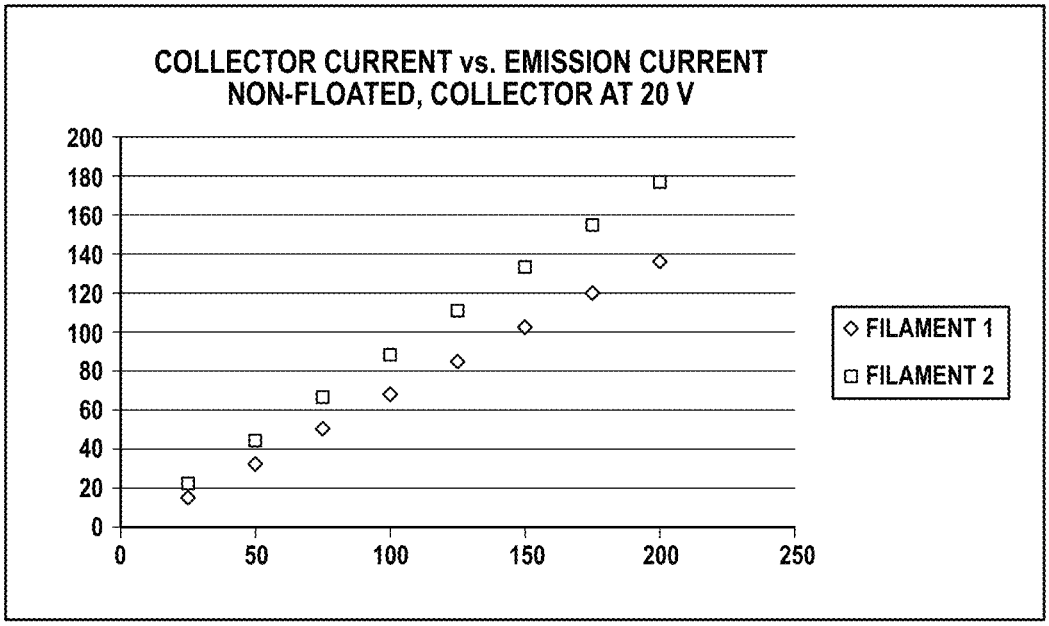
FIG. 8 depicts experimental data illustrating a comparison between measured collector current on the Y axis and setpoint emission current on the X axis for a dual filament assembly when acquired in accordance with the setup of FIG. 3A with switch 25 in the upper (ground referenced) position.

Shown in FIG. 8 is a graph illustrating a comparison between collector current and emission current for a dual filament assembly as measured from a ground referenced electron lens power supply when acquired in accordance with FIG. 3A with switch 25 in the upper (ground referenced) position (a). Such dual filament assemblies are described in U.S. Pat. No. 7,902,529. The X axis represents the setpoint emission current, while the Y axis is the measured collector current. The experimental setup of FIG. 3A is emission current regulated but uses a separate collector 40 to determine the emission characteristics of the electron source in emission current regulation mode. As described above, electrons which strike the electron gate lens 31 are counted as emission current when the electron lens bias has a path to earth ground. Since these electrons do not participate in the ionization process, they can be considered to contribute to "false" emission current, introducing errors into the emission measurement systems and controls. The data of FIG. 8 was gathered with an electron lens bias of +15V relative to earth ground, and a filament potential of −70V relative to earth ground.

Figure 9:
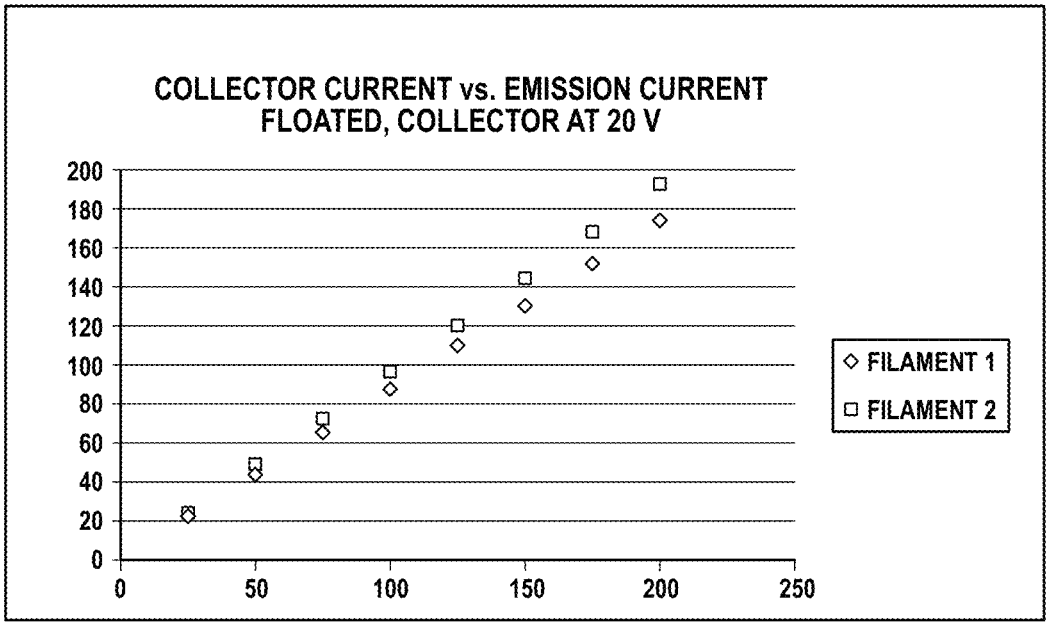
FIG. 9 depicts experimental data illustrating a comparison between measured collector current on the Y axis and setpoint emission current on the X axis for a dual filament assembly when acquired in accordance with the setup of FIG. 3A with switch 25 in the lower (filament referenced) position.

Shown in FIG. 9 is a graph illustrating a comparison between collector current and emission current for a dual filament supply as measured from a floated electron gating scheme, such as the experimental setup of FIG. 3A with switch 25 moved to the lower (filament referenced) position (b). The X axis represents the setpoint emission current, while the Y axis is the measured collector current. In this case, electrons which strike the electron gate lens 31 are not counted as emission current but are instead returned to the filament supply 38, greatly reducing the "false" emission current registered by the emission measurement system and controls. Thus, the closed loop nature of the emission control circuit will compensate for the error. The bias supply of FIG. 9 was set to +85V such that the electron lens potential resulted in +15V relative to earth ground. The filament was set to −70V with respect to earth ground. While the emission and collector currents shown in FIG. 8 and FIG. 9 represent steady state currents for non-pulsed operation, further improvements can be realized in pulsed modes of operation.

One difficulty which arises with non-trapping beam instruments, such as quadrupoles, is the need to pulse at higher frequencies such as 10 to 50 kHz in order to control ion populations using pulse width modulation. This can generate difficulties in controlling emission, since it is more difficult to match slew rates inherent in separate power supplies and associated load capacitances. However, as the switch times are much faster (10 kHz or above) the rise and fall time difference of the potentials for the electron lens and filament become significant at low duty cycles. In particular, the entire circuit for the floating filament must exhibit high isolation and minimal capacitance to ground. Even if great care is made in the isolation circuitry of the filament power supply, the switch time of the electron lens is generally much faster. By using a floating electron lens bias supply which rides on top of the filament potential as shown in FIG. 7, the slew rate of the electron lens is handicapped to perfectly match the slew rate of the filament resulting in less noise being generated on the emission sense circuit.

Figure 10:
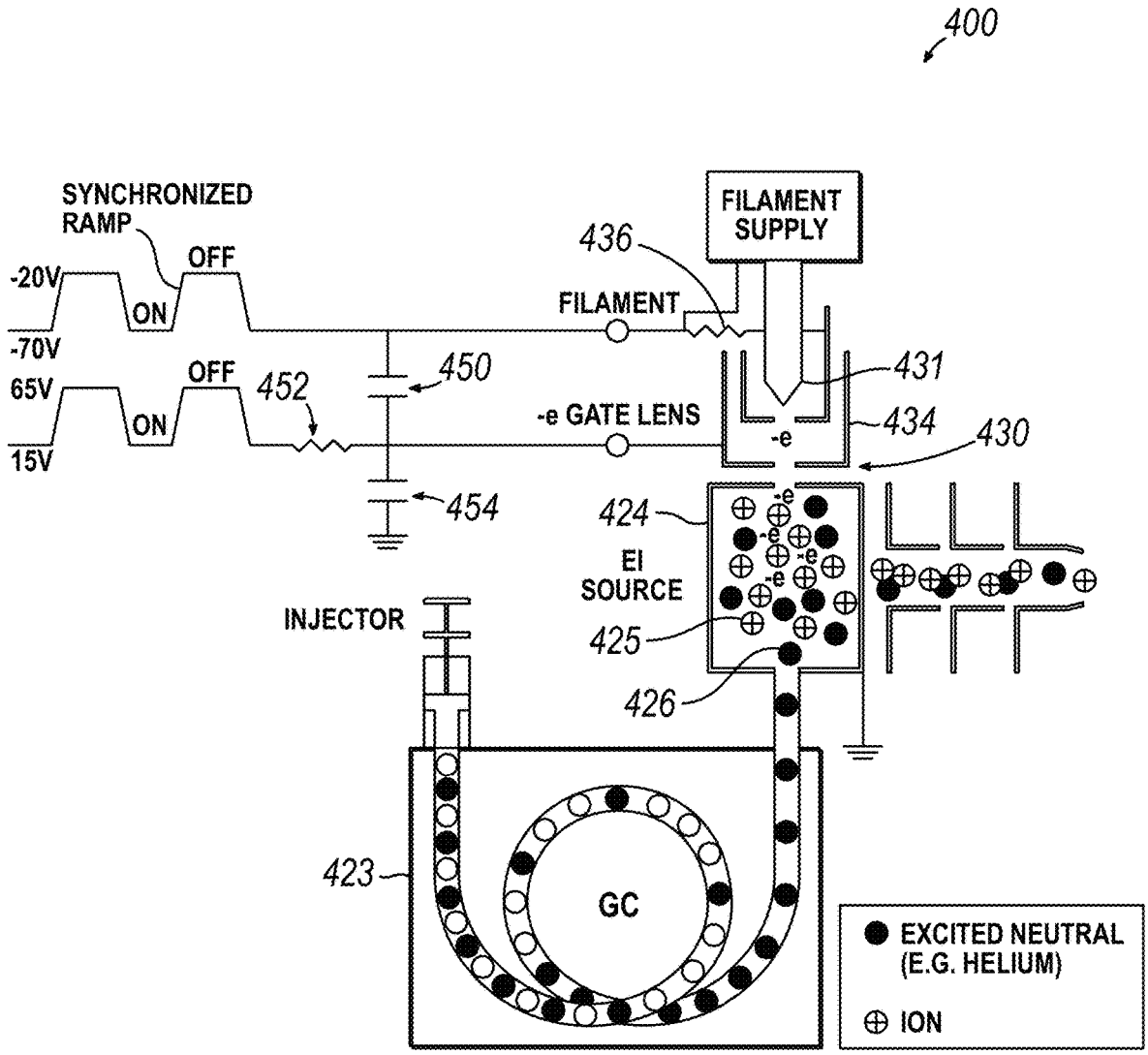
FIG. 10 depicts an alternative embodiment wherein electron lens slew rate matching can be affected.

As an alternative to the foregoing method of matching slew rates by virtue of floating the electron lens supply with the filament supply, it has been realized that slew rate matching in pulsed operation can be accomplished in a relatively simple way for multiple ground referenced power supplies. FIG. 10 shows a mass spectrometer 400 in accordance with an embodiment which includes substantially the same features and functionality as ion trap mass spectrometers 100, 200, except as otherwise described below. Accordingly, spectrometer 400 includes a gas chromatograph 423 which provides sample gas to an ion volume 424, and an electron source 430 which provides energetic electrons to the ion source to ionize the atoms and molecules in said device and form positive ions 425 and undesired excited neutrals 426. Further, the energy of electrons entering the ion source volume 424 is controlled by the voltage between the filament 431 and the ion source volume 424. Spectrometer 400 also incorporates an emission current sensing resistor 436 for measuring the current emitted from the filament 431 using the technique described above with reference to FIG. 4. In the embodiment of FIG. 10, however, a floated (i.e., a non-ground referenced) capacitor 450 bridging the power supply rails of the filament 431 and electron lens 434 can be included along with resistor 452 to form a floating RC circuit. The values of capacitor 450 and resistor 452 are selected to cause the electron lens voltage slew rate to match, or otherwise substantially align with, the filament power supply voltage slew rate. An additional, optional capacitor 454 may be provided to the RC circuit, for example, by coupling the output of the power supply for the electron lens 434 to an electrical ground source, to compensate for any instrument-to-instrument differences in the capacitance of electron lens 434 and associated lead wires, board traces etc. Since the capacitance of the electron lens is quite low, this compensation capacitor can be added such that the relative differences in capacitance between instruments are reduced. For example, if one instrument exhibits 10 picofarads of electron lens capacitance to ground while a second instrument exhibits 20 picofarads to ground, the relative difference is 2×. By selecting a value of 50 picofarads for capacitor 454, the first instrument will exhibit 60 picofarads of capacitance to ground while instrument two exhibits 70 picofarads or a relative difference of 1.17×. Typical values for capacitor 450, resistor 452, and capacitor 454 can be, in one example, 1 nano-farad, 5300 ohms, and 50 picofarads, respectively. However, the chosen values for capacity 450, resistor 452, and capacitor 454 may each be varied while still providing the same or a substantially similar functionality as is described herein.

The above methods of slew rate matching allow a precise potential difference between the filament and electron lens during switching intervals. As described, this reduces noise in the feedback circuitry by largely eliminating positive and negative going spikes in potential difference of these two elements, and the resultant noise in the emission sense circuitry.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An ion source assembly, comprising:

an electron source configured to inject electrons into an ion volume to ionize an atom or molecule in the ion volume, wherein the electron source includes a filament;

a lens electrode positioned adjacent the electron source and including an opening, wherein the opening is configured to pass electrons therethrough from the electron source into the ion volume;

a supply voltage source coupled to the filament, wherein the supply voltage source is configured to supply a first voltage to the filament, wherein the first voltage is operable to ionize the molecules in the ion volume; and a bias voltage source coupled to the supply voltage source and configured to supply a bias voltage to the lens electrode, wherein electrons striking the lens electrode are returned to the filament.

2. The ion source assembly of claim 1, wherein the supply voltage source is configured to supply a second voltage to the filament, wherein the second voltage is inoperable to ionize the molecules in the ion volume.

3. The ion source assembly of claim 2, wherein the supply voltage source is configured to alternate between supplying the first voltage and the second voltage.

4. The ion source assembly of claim 2, wherein the first voltage is −70 volts and the second voltage is −20 volts.

5. The ion source assembly of claim 2, wherein the lens electrode voltage is equal to 15 volts when the supply voltage source supplies the first voltage, wherein the lens electrode voltage is equal to 65 volts when the supply voltage source supplies the second voltage.

6. The ion source assembly of claim 1, wherein the filament is electrically floated.

7. The ion source assembly of claim 1, wherein the lens electrode is electrically floated.

8. The ion source assembly of claim 1, wherein the ion volume is electrically grounded.

9. The ion source assembly of claim 1, wherein the bias voltage source includes a direct-current (DC) bias power supply.

10. The ion source assembly of claim 1, wherein the fixed voltage potential of the bias voltage source relative to the supply voltage source is 85 volts.

11. The ion source assembly of claim 1, wherein the electron source is configured to inject electrons into the ion volume at a fixed or variable duty cycle.

12. An ion source assembly, comprising:

an electron source configured to emit electrons, wherein the electron source includes an electrically floated filament, wherein a first portion of the electrons enters an ion volume to ionize an atom or molecule in the ion volume;

a lens electrode positioned adjacent the electron source, wherein the lens electrode is electrically floated;

a supply voltage source coupled to the filament, wherein the supply voltage source is configured to supply a first voltage to the filament, wherein the first voltage is operable to ionize the molecules in the ion volume; and a bias voltage source coupled to the supply voltage source and configured to supply a bias voltage to the lens electrode;

wherein the lens electrode is configured to collect a second portion of the electrons, wherein the second portion of the electrons flows back to the filament.

13. The ion source assembly of claim 12, wherein the supply voltage source is configured to supply a second voltage to the filament, wherein the second voltage is inoperable to ionize the molecules in the ion volume.

14. The ion source assembly of claim 13, wherein the first voltage is −70 volts and the second voltage is −20 volts.

15. The ion source assembly of claim 12, wherein the bias voltage remains at a fixed voltage potential relative to the supply voltage source.

16. The ion source assembly of claim 15, wherein the fixed voltage potential of the bias voltage source relative to the supply voltage source is 85 volts.

17. An ion source assembly, comprising:

a filament configured to emit electrons via thermionic emission;

a lens electrode surrounding the filament;

a first power supply coupled to the filament, wherein the first power supply is configured to supply a first voltage output at a first voltage slew rate to the filament, wherein the first voltage output is operable to ionize molecules;

a second power supply coupled to the lens electrode, wherein the second power supply is configured to supply a second voltage output at a second voltage slew rate to the lens electrode; and a first capacitor coupling the first voltage output to the second voltage output.

18. The ion source assembly of claim 17, further comprising a resistor coupled between the second voltage output and the lens electrode, wherein the first capacitor and the resistor are operable to align the first voltage slew rate with the second voltage slew rate.

19. The ion source assembly of claim 17, further comprising a second capacitor configured to couple the second voltage output to an electrical ground, wherein the second capacitor is operable to reduce relative instrument-to-instrument variability in electron lens capacitance.

20. The ion source assembly of claim 17, wherein the first power supply is configured to alternate between a high first voltage output and a low first voltage output, wherein the second power supply is configured to alternate between a high second voltage output and a low second voltage output, wherein the second voltage output remains at a fixed voltage potential relative to the first voltage output.

* * * * *